US006318390B1

(12) United States Patent
Innis

(10) Patent No.: US 6,318,390 B1
(45) Date of Patent: Nov. 20, 2001

(54) INFLATABLE UMBRELLA

(76) Inventor: Erik V. Innis, 17 Lytton Boulevard, Toronto, Ontario M4R 1K9 (CA)

( * ) Notice: Subject to any disclaimer, the term of this patent is extended or adjusted under 35 U.S.C. 154(b) by 0 days.

(21) Appl. No.: 09/595,468

(22) Filed: Jun. 16, 2000

(51) Int. Cl.[7] ..... A45B 19/02

(52) U.S. Cl. ..... 135/20.2; 135/22; 52/2.13; 52/2.18

(58) Field of Search ..... 52/2.13, 2.18; 135/15.1, 20.2, 22

(56) References Cited

U.S. PATENT DOCUMENTS

| | | | | |
|---|---|---|---|---|
| D. 247,328 | | 2/1978 | Yoshida . | |
| D. 266,456 | | 10/1982 | Strickler . | |
| 1,411,560 | * | 4/1922 | Beaty | 135/20.2 |
| 2,810,391 | * | 10/1957 | Jones, Jr. | 135/20.2 |
| 3,802,451 | * | 4/1974 | Morris | 135/20.2 |
| 3,889,700 | | 6/1975 | Kirley . | |
| 3,954,117 | | 5/1976 | Wallace . | |
| 4,643,210 | | 2/1987 | Feld . | |
| 4,870,983 | * | 10/1989 | Wang | 135/20.2 |
| 4,876,829 | * | 10/1989 | Mattick | 52/2.18 |
| 5,040,555 | | 8/1991 | Wang . | |
| 6,192,633 | * | 2/2001 | Hilbert | 52/2.18 |

* cited by examiner

*Primary Examiner*—Beth A. Stephan
*Assistant Examiner*—Brian E. Glessner

(57) ABSTRACT

An inflatable umbrella for providing an umbrella that can be carried in one's pocket or purse. The inflatable umbrella includes a flexible and foldable sheet of material having a central portion and a perimeter; and also includes a hub air chamber being securely attached to the central portion; and further includes a plurality of flexible rib-like air chambers connected to the hub air chamber and extending radially from the hub air chamber and being securely attached to the sheet of material with each of the rib-like air chambers having a first end and a second end which is securely connected to the hub air chamber; and also includes a flexible annular air chamber being connected to the first ends of the rib-like air chambers and being securely attached along the perimeter of the flexible sheet of material; and further includes a handle air chamber being integrally connected to the hub air chamber and depending therefrom; and an inflating and deflating assembly for inflating and deflating the air chambers.

8 Claims, 2 Drawing Sheets

INFLATABLE UMBRELLA

BACKGROUND OF THE INVENTION

1. Field of the Invention

The present invention relates to an umbrella and more particularly pertains to a new inflatable umbrella for providing an umbrella that can be carried in one's pocket or purse.

2. Description of the Prior Art

The use of an umbrella is known in the prior art. More specifically, an umbrella heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 3,889,700; 3,954,117; 4,643,210; 5,040,555; U.S. Pat. Nos. Des. 247,328; and 266,456.

While these devices fulfill their respective, particular objectives and requirements, the aforementioned patents do not disclose a new inflatable umbrella. The inventive device includes a flexible and foldable sheet of material having a central portion and a perimeter; and also includes a hub air chamber being securely attached to the central portion; and further includes a plurality of flexible rib-like air chambers connected to the hub air chamber and extending radially from the hub air chamber and being securely attached to the sheet of material with each of the rib-like air chambers having a first end and a second end which is securely connected to the hub air chamber; and also includes a flexible annular air chamber being connected to the first ends of the rib-like air chambers and being securely attached along the perimeter of the flexible sheet of material; and further includes a handle air chamber being integrally connected to the hub air chamber and depending therefrom; and an inflating and deflating assembly for inflating and deflating the air chambers.

In these respects, the inflatable umbrella according to the present invention substantially departs from the conventional concepts and designs of the prior art, and in so doing provides an apparatus primarily developed for the purpose of providing an umbrella that can be carried in one's pocket or purse.

SUMMARY OF THE INVENTION

In view of the foregoing disadvantages inherent in the known types of umbrella now present in the prior art, the present invention provides a new inflatable umbrella construction wherein the same can be utilized for providing an umbrella that can be carried in one's pocket or purse.

The general purpose of the present invention, which will be described subsequently in greater detail, is to provide a new inflatable umbrella which has many of the advantages of the umbrella mentioned heretofore and many novel features that result in a new inflatable umbrella which is not anticipated, rendered obvious, suggested, or even implied by any of the prior art umbrella, either alone or in any combination thereof.

To attain this, the present invention generally comprises a flexible and foldable sheet of material having a central portion and a perimeter; and also includes a hub air chamber being securely attached to the central portion; and further includes a plurality of flexible rib-like air chambers connected to the hub air chamber and extending radially from the hub air chamber and being securely attached to the sheet of material with each of the rib-like air chambers having a first end and a second end which is securely connected to the hub air chamber; and also includes a flexible annular air chamber being connected to the first ends of the rib-like air chambers and being securely attached along the perimeter of the flexible sheet of material; and further includes a handle air chamber being integrally connected to the hub air chamber and depending therefrom; and an inflating and deflating assembly for inflating and deflating the air chambers.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new inflatable umbrella which has many of the advantages of the umbrella mentioned heretofore and many novel features that result in a new inflatable umbrella which is not anticipated, rendered obvious, suggested, or even implied by any of the prior art umbrella, either alone or in any combination thereof.

It is another object of the present invention to provide a new inflatable umbrella which may be easily and efficiently manufactured and marketed.

It is a further object of the present invention to provide a new inflatable umbrella which is of a durable and reliable construction.

An even further object of the present invention is to provide a new inflatable umbrella which is susceptible of a low cost of manufacture with regard to both materials and labor, and which accordingly is then susceptible of low prices of sale to the consuming public, thereby making such inflatable umbrella economically available to the buying public.

Still yet another object of the present invention is to provide a new inflatable umbrella which provides in the apparatuses and methods of the prior art some of the advantages thereof, while simultaneously overcoming some of the disadvantages normally associated therewith.

Still another object of the present invention is to provide a new inflatable umbrella for providing an umbrella that can be carried in one's pocket or purse.

Yet another object of the present invention is to provide a new inflatable umbrella which includes a flexible and foldable sheet of material having a central portion and a perimeter; and also includes a hub air chamber being securely attached to the central portion; and further includes a plurality of flexible rib-like air chambers connected to the hub air chamber and extending radially from the hub air chamber and being securely attached to the sheet of material with each of the rib-like air chambers having a first end and a second end which is securely connected to the hub air chamber; and also includes a flexible annular air chamber being connected to the first ends of the rib-like air chambers and being securely attached along the perimeter of the flexible sheet of material; and further includes a handle air chamber being integrally connected to the hub air chamber and depending therefrom; and an inflating and deflating assembly for inflating and deflating the air chambers.

Still yet another object of the present invention is to provide a new inflatable umbrella that is lightweight and can be quickly extended within seconds.

Even still another object of the present invention is to provide a new inflatable umbrella that would be readily available and accessible by the user whenever an umbrella is needed.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
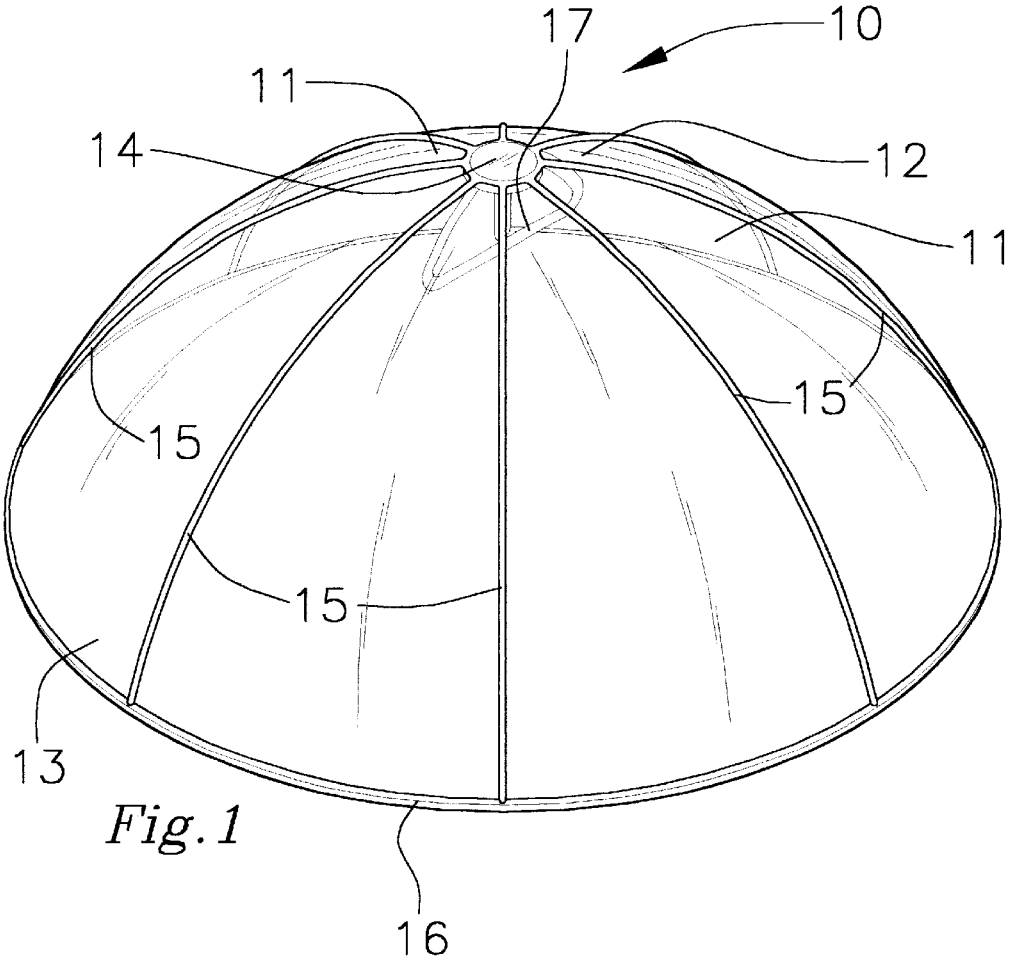
FIG. 1 is a top perspective view of a new inflatable umbrella according to the present invention.
Figure 2:
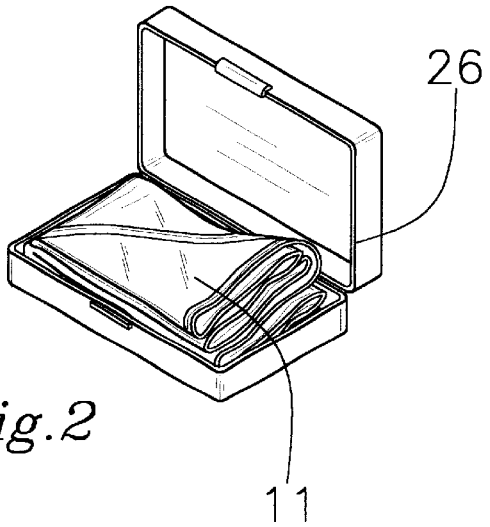
FIG. 2 is a perspective view of the present invention being folded up in a carrying case.
Figure 3:
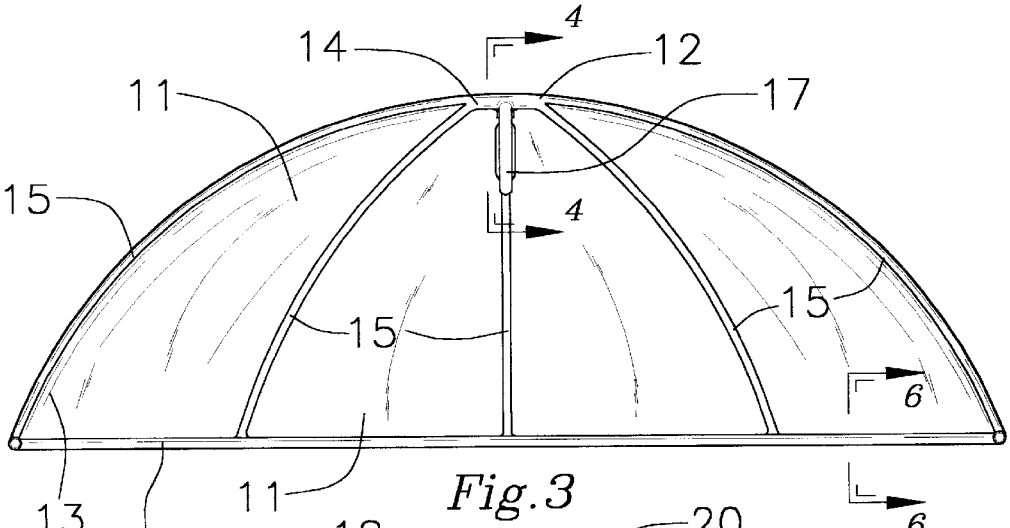
FIG. 3 is a side elevational view of the present invention.
Figure 4:
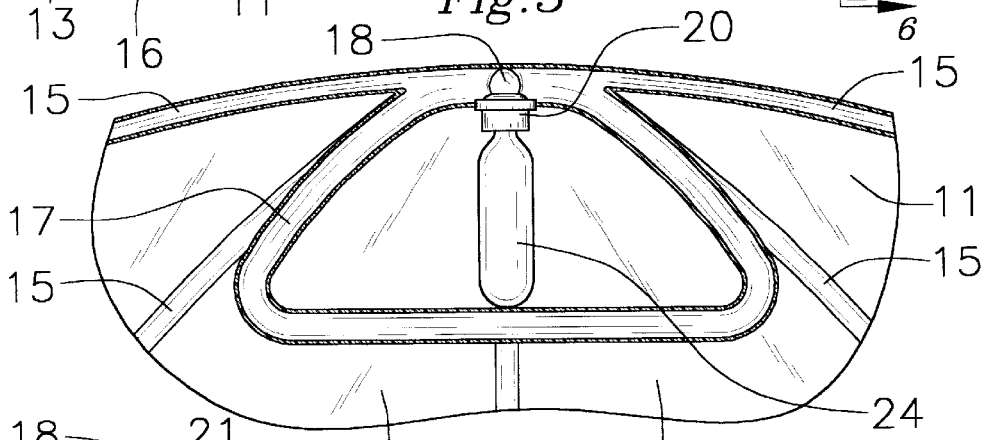
FIG. 4 is a detailed side elevational view of the handle air chamber and the means for inflating air chambers of the present invention.
Figure 5:
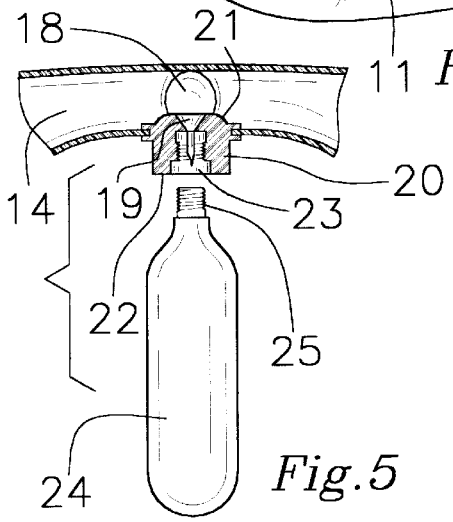
FIG. 5 is a detailed side elevational view of the means for inflating the air chambers of the present invention.
Figure 6:
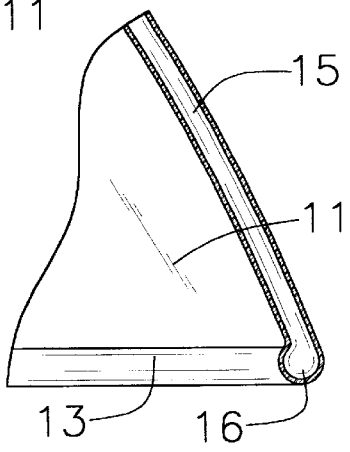
FIG. 6 is a detailed partial side elevational view of one of the rib-like air chambers and the annular air chamber of the present invention.

With reference now to the drawings, and in particular to FIGS. 1 through 6 thereof, a new inflatable umbrella embodying the principles and concepts of the present invention and generally designated by the reference numeral 10 will be described.

As best illustrated in FIGS. 1 through 6, the inflatable umbrella 10 generally comprises a flexible and foldable sheet of material 11 having a central portion 12 and a perimeter 13. A hub air chamber 14 is securely and conventionally attached to the central portion 12. A plurality of flexible rib-like air chambers 15 are connected to the hub air chamber 14 and extend radially from the hub air chamber 14 and are securely and conventionally attached to the sheet of material 11. Each of the rib-like air chambers 15 has a first end and a second end which is securely connected to the hub air chamber 14. A flexible annular air chamber 16 is connected to the first ends of the rib-like air chambers 15 and are securely and conventionally attached along the perimeter 13 of the flexible sheet of material 11. A handle air chamber 17 is integrally connected to the hub air chamber 14 and depends therefrom with the handle air chamber 17 being essentially a closed loop and extending outwardly from the hub air chamber 14 and being adapted to be grasped by a user to hold and carry the inflatable umbrella 10. Means for inflating and deflating the air chambers 14–16 includes an air-inlet port 18 extending into the hub air chamber 14, and also includes a cartridge holding member 20 being securely and conventionally attached to the hub air chamber 14 over and upon the air-inlet port 18, and further includes a needle-like valve 19 being securely and conventionally disposed within the cartridge holding member 20, and also includes a cartridge 24 containing air and being securely and removably held by the cartridge holding member 20 for supplying air to the air chambers 14–16. The cartridge holding member 20 has an open bottom end 22, a top end 21 which is securely and conventionally attached to the hub air chamber 14, and a threaded bore extending therein through the open bottom end 22. The needle-like valve 19 extends through the top end 21 of the cartridge holding member 20 and is adapted to extend into the cartridge 24 to dispense air from the cartridge 24 into the air chambers 14–16. The cartridge 24 has a threaded neck portion 25 which is adapted to be threaded into the bore 23 of the cartridge holding member 20 through the open bottom end 22. The sheet of material 11 is essentially dome-shaped upon the inflatable umbrella 10 being inflated with air from the cartridge 24 with the dome-shaped sheet of material 11 having a diameter of approximately 30 inches and a height of approximately 12 inches. The cartridge 24 essentially holds pressurized carbon dioxide.

In use, the user can easily and quickly unfold the inflatable umbrella 10 from one's pocket, purse, or a carrying case 26, and can removably connect the cartridge 24 to the cartridge holding member 20 with the needle-like valve 19 being used to open the pressurized cartridge 20 to dispense the air from the cartridge 20 into the air chambers 14–16 to essentially inflate the umbrella 10. To deflate the air chambers 14–16, the user can insert an air release member into the needle-like valve 19 so that the user can fold up the inflatable umbrella 10 for the next time.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An inflatable umbrella comprising:

a flexible and foldable sheet of material having a central portion and a perimeter;

a hub air chamber being securely attached to said central portion;

a plurality of flexible rib-like air chambers connected to said hub air chamber and extending radially from said hub air chamber and being securely attached to said sheet of material, each of said rib-like air chambers having a first end and a second end which is securely connected to said hub air chamber;

a flexible annular air chamber being connected to said first ends of said rib-like air chambers and being securely attached along said perimeter of said flexible sheet of material;

a handle air chamber being integrally connected to said hub air chamber and depending therefrom;

means for inflating and deflating said air chambers; and wherein said means for inflating and deflating said air chambers includes an air-inlet port extending into said hub air chamber, and also includes a cartridge holding member being attached to said hub air chamber upon said air-inlet port, and further includes a needle-like valve being securely disposed within said cartridge holding member, and also includes a cartridge containing air and being securely and removably held by said cartridge holding member for supplying to said chambers.

2. An inflatable umbrella as described in claim 1, wherein said handle air chamber is essentially a closed loop and extends outwardly from said hub air chamber and is adapted to be grasped by a user to hold and carry said inflatable umbrella.

3. An inflatable umbrella as described in claim 1, wherein said cartridge holding member has an open bottom end, a top end which is securely attached to said hub air chamber, and a threaded bore extending therein through said open bottom end.

4. An inflatable umbrella as described in claim 3, wherein said needle-like valve extends through said top end of said cartridge holding member and is adapted to extend into said cartridge to dispense air from said cartridge into said air chambers.

5. An inflatable umbrella as described in claim 4, wherein said cartridge has a threaded neck portion which is adapted to be threaded into said bore of said cartridge holding member through said open bottom end.

6. An inflatable umbrella as described in claim 1, wherein said sheet of material is dome-shaped upon said inflatable umbrella being inflated with air from said cartridge, said dome-shaped sheet of material having a diameter of approximately 30 inches and a height of approximately 12 inches.

7. An inflatable umbrella as described in claim 1, wherein said cartridge essentially holds pressurized carbon dioxide.

8. An inflatable umbrella comprising a flexible and foldable sheet of material having a central portion and a perimeter;

a hub air chamber being securely attached to said central portion;

a plurality of flexible rib-like air chambers connected to said hub air chamber and extending radially from said hub air chamber and being securely attached to said sheet of material, each of said rib-like air chambers having a first end and a second end which is securely connected to said hub air chamber;

a flexible annular air chamber being connected to said first ends of said rib-like air chambers and being securely attached along said perimeter of said flexible sheet of material;

a handle air chamber being integrally connected to said hub air chamber and depending therefrom, said handle air chamber being essentially a closed loop and extending outwardly from said hub air chamber and being adapted to be grasped by a user to hold and carry said inflatable umbrella; and means for inflating and deflating said air chambers including an air-inlet port extending into said hub air chamber, and also including a cartridge holding member being attached to said hub air chamber upon said air-inlet port, and further including a needle-like valve being securely disposed within said cartridge holding member, and also including a cartridge containing air and being securely and removably held by said cartridge holding member for supplying air to said chambers, said cartridge holding member having an open bottom end, a top end which is securely attached to said hub air chamber, and a threaded bore extending therein through said open bottom end, said needle-like valve extending through said top end of said cartridge holding member and being adapted to extend into said cartridge to dispense air from said cartridge into said air chambers, said cartridge having a threaded neck portion which is adapted to be threaded into said bore of said cartridge holding member through said open bottom end, said sheet of material being dome-shaped upon said inflatable umbrella being inflated with air from said cartridge, said dome-shaped sheet of material having a diameter of approximately 30 inches and a height of approximately 12 inches, said cartridge essentially holding pressurized carbon dioxide.

* * * * *